United States Patent [19]

Gallant

[11] Patent Number: 4,938,141

[45] Date of Patent: Jul. 3, 1990

[54] SHOCK INITIATOR DEVICE FOR INITIATING A PERCUSSION PRIMER

[75] Inventor: W. Keith Gallant, Minnetonka, Minn.

[73] Assignee: Honeywell Inc., Minneapolis, Minn.

[21] Appl. No.: 368,477

[22] Filed: Jun. 19, 1989

[51] Int. Cl.[5] ..... F42B 19/08

[52] U.S. Cl. ..... 102/275.4; 102/275.7; 102/275.11

[58] Field of Search ..... 102/275.3, 275.2, 275.4, 102/275.6, 275.9, 275.11, 275.12, 204, 200

[56] References Cited

U.S. PATENT DOCUMENTS

| | | | |
|---|---|---|---|
| 3,209,692 | 10/1965 | Webb | 102/275.4 |
| 3,238,876 | 3/1966 | Allen | 102/275.4 |
| 3,460,477 | 8/1969 | Heidemann et al. | 102/275.2 |
| 3,945,322 | 3/1976 | Carlson et al. | 102/275.3 |
| 3,991,679 | 11/1976 | Savitt et al. | 102/275.4 |
| 4,608,926 | 9/1986 | Stevens | 102/275.4 |
| 4,653,400 | 3/1987 | Crawford | 102/275.7 |
| 4,699,059 | 10/1987 | Kelly et al. | 102/275.7 |
| 4,759,291 | 7/1988 | Barker et al. | 102/275.5 |
| 4,817,530 | 4/1989 | Florin | 102/204 |

*Primary Examiner*—David H. Brown

*Attorney, Agent, or Firm*—Roger W. Jensen

[57] ABSTRACT

A shock wave initiator device for initiating a percussion primer includes a primary explosive, an attenuation body, and a deflagrating member. The primary explosive is of a type which upon ignition is capable of detonation for producing a shock wave. The attenuation body is a block or core of material which at its exterior engages a cup of a primer enclosing primer mix and at its interior has a cavity housing the primary explosive. The body is capable of transmitting the shock wave produced by the detonation to the primer cup. The deflagrating member is preferably a rapid burn cord with one end communicating with the primary explosive and an opposite end communicating with a source of input energy for igniting the cord to cause burning thereof which, in turn, ignites and detonates the primary explosive.

10 Claims, 1 Drawing Sheet

SHOCK INITIATOR DEVICE FOR INITIATING A PERCUSSION PRIMER

BACKGROUND OF THE INVENTION

The Government has rights in this invention pursuant to Contract No. DAAA21-86-C-0308, awarded by the Department of the Army.

1. Field of the Invention

The present invention generally relates to a activation of percussion primers and, more particularly, is concerned with a device for producing a shock wave to initiate a percussion primer.

2. Description of the Prior Art

A thermal battery is a cell typically used to provide energy for a short period of time. Their small size allows for their application in munitions which must be powered during flight. One way in which a thermal battery may be activated is through the functioning of a pistol primer, such as of the M42G type. The pistol primer is installed in a pocket and includes a primer mix enclosed by a cup. The primer is activated by impact upon the primer cup of a small ball, a firing pin or some other similar kinetic energy device. The primer mix within the cup is ignited by the friction and crush caused by the firing pin.

A major drawback of this initiation scheme is that it has led to the perforation and subsequent venting of the primer cup. A high probability therefore exists that the cup of the pistol primer will be breached by the action of the firing pin or weakened so that the pressure generated in the cell will then cause it to vent. There is a concomitant probability that the efficiency of the thermal battery or cell will thereby be reduced. It is highly desirable to maintain the integrity of the primer to ensure that cell performance will not be compromised.

Consequently, a need exists to eliminate the above-described drawback associated with activation of a thermal battery.

SUMMARY OF THE INVENTION

The present invention provides a shock initiator device designed to satisfy the aforementioned needs. The approach of the present invention is to produce and drive a shock wave through an attenuation material and the cup of the primer to initiate the primer mix directly rather than through the more traditional method of physically applying friction and crush to the primer cup by a firing pin to initiate or ignite the primer mix.

One advantage of the approach of the present invention is that the cup of the primer is impacted only by a shock wave and not physically by a hard object. Therefore, the cup is not structurally weakened as it was before by the impact of a firing pin or other kinetic energy source. Another advantage of the approach is that additional protection is provided to the cell in that the weakest part of the structure, the primer, is backed up by a material in contact with it that will inhibit its movement and will also tend to absorb the shock wave energy produced in the primer itself. A further advantage of the approach is that activation energy for the primer may be applied from the vertical or horizontal directions thus allowing for reduction in the head heights of the activation mechanism if required.

Accordingly, the present invention is directed to a shock initiator device for initiating a percussion primer having a cup enclosing a primer mix. The shock initiator device comprises: (a) a primary explosive of a type which upon ignition is capable of detonation and thereby producing a shock wave; (b) a body for engaging the cup of the primer enclosing the primer mix, the body being an attenuation material encompassing the primary explosive and capable of transmitting the shock wave produced by the detonation to the primer mix via the primer cup; and (c) an energy transfer link for communicating a source of input energy to the primary explosive for igniting the primary explosive which then detonates.

More particularly, the energy transfer link can be a deflagrating member, such as a rapid deflagrating cord, having a predetermined burn time. The deflagrating member has one end communicating with the primary explosive and an opposite end communicating with the source of input energy for igniting the deflagrating member to cause burning thereof which, in turn, ignites the primary explosive which then detonates.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
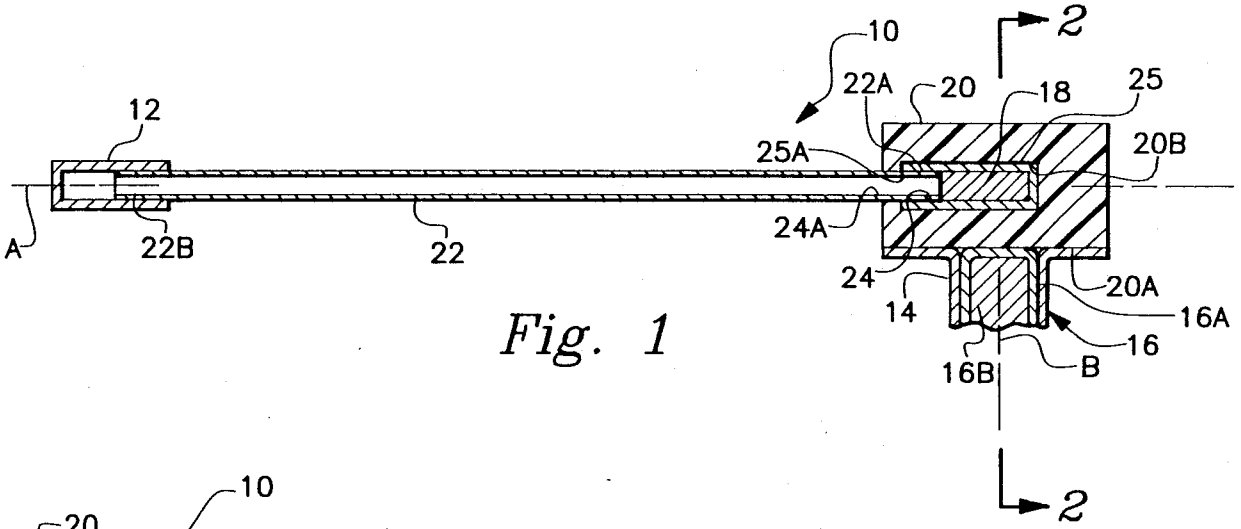
FIG. 1 is a longitudinal sectional view of one embodiment of a shock initiator device in accordance with the present invention.

Referring now to the drawings, and in particular to FIG. 1, there is shown a shock initiator device, generally designated by the numeral 10 and constructed in accordance with the principles of the present invention. The shock initiator device 10 provides an energy communication link from an input energy source 12, such as a primer contained in a fuze safe and arm device (not shown), to a pocket 14 enclosing a percussion primer 16 of a device, such as a thermal battery (not shown). The percussion primer 16, conventional in construction, typically includes a cup 16A enclosing a primer mix, cover and anvil, all of which are not shown individually but are collectively designated as 16B.

In its basic components, the shock initiator device 10 includes a primary explosive 18, an energy attenuation body 20, and an energy transfer or communication link 22, preferably in the form of a deflagrating member. The energy transfer link 22 can also take other suitable forms, such as an electrical transmission line, an explosive medium, or a medium producing a flash. The primary explosive 18 of the shock initiator device 10 is of a type which upon ignition is capable of detonation for producing a shock wave. In other words, the material selected for the primary explosive 18 must be of the type which upon ignition almost instantaneously flips over into a detonation to produce the shock wave. A detonation is needed to produce a shock wave having sufficient energy to, in turn, initiate the primer 16. One suitable material for constituting the primary explosive 18 is lead azide.

The energy attenuation body 20 of the shock initiator device 10 is a block or core of material having a central cavity 24 housing the primary explosive 18, for instance, in a cup 25. At its exterior 20A, the attenuation body 20 engages an end of the cup 16A of the primer 16. At its interior 20B defining the cavity 24, the attenuation body 20 contacts the cup 25 encompassing the primary explosive 18. The body 20 can be any suitable shape and composed of any suitable material, such as a plastic. The essential characteristic of the body 20 is that it be capable of transmitting the shock wave produced by the detonation of the primary explosive 18 to the primer 16.

The energy transfer link in the form of the deflagrating member 22 of the shock initiator device 10 provides an energy transmission or communication path between the input energy source 12 and the primary explosive 18. Preferably, the deflagrating member 22 is a rapid burn cord. One end 22A of the member 22 extends through an opening 24A to the cavity 24 in the attenuation body 20 and an opening 25A to the cup 26 therein, and into energy communicative contact with the primary explosive 18 in the cup 25. The opposite end 22B of the member 22 is disposed in energy communicative contact with the input energy source 12. The member 22 has a predetermined or known burn time, by way of example, on the order of several thousand inches per second. The input energy source 12 provides sufficient energy to ignite or start deflagration of the member 22 at its end 22B. The burn zone advances rapidly along the member 22 toward its other end 22A. Upon reaching the latter end 22A, the burn zone provides sufficient energy to ignite the primary explosive 18. The characteristic of the primary explosive 18 is to then, almost instantaneously, detonate at a rate, by way of example, of several thousand meters per second, which is sufficient to produce the desired shock wave.

Figure 2:
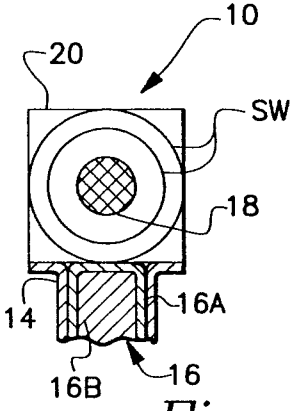
FIG. 2 is a cross-sectional view of the device taken along line 2—2 of FIG. 1.

As represented in FIG. 2, the shock wave SW generated by the detonation of the primary explosive 18 propagates or expands radially outward therefrom through the attenuation body 20. The shock wave SW is transmitted to the primer 16 through a portion of the exterior 20A of the body 20 contacting the cup 16A of the primer 16. The primer cup 16A, in turn, transmits the shock wave to the primer mix 16B contained in the cup, producing direct initiation of the primer mix 16B and not just ignition thereof as Was accomplished heretofore when using a firing pin.

Figure 3:
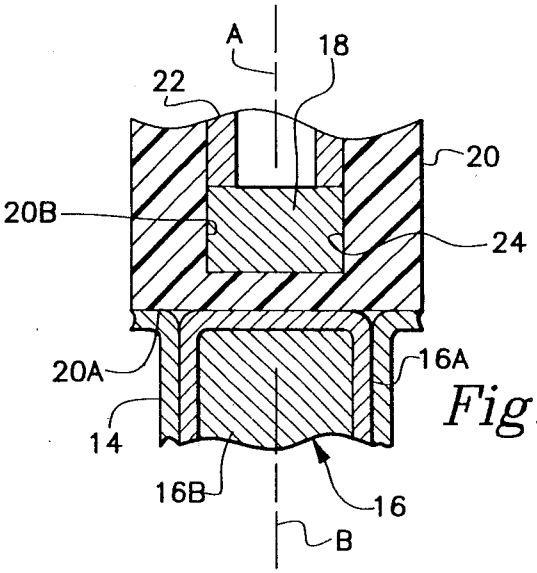
FIG. 3 is an enlarged fragmentary longitudinal sectional view of another embodiment of the shock initiator device.

It will be observed in FIG. 1 that the longitudinal axis A of shock initiator device 10 is arranged generally horizontal or in an orthogonal relation to the generally vertical axis B of the primer 16. FIG. 3 shows that the shock initiator device 10 can alternatively be arranged with its axis A extending generally vertical or in a coaxial relation to the axis B of the primer 16. For that matter, the shock initiator device 10 can be placed with its axis A at any angle between the horizontal and vertical relative to the axis B of the primer 16 and still accomplish the same result. Thus, the burn zone in the deflagrating material 22 can proceed from any direction toward the primary explosive 18 and still achieve the same result. This is not true in the case of the prior art approach of using a firing pin. The firing pin must be applied essentially in the vertical direction or along the axis of the primer. This flexibility of the shock initiator device 10 of the present invention in being able to apply activation energy for the primer from any angle between the vertical and horizontal directions allows for reduction in the head heights of the activation mechanism if required.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A shock wave initiator device for initiating a percussion primer, said device comprising:

(a) a primary explosive of a type which upon ignition is capable of detonation and thereby producing a shock wave;

(b) a cup enclosing said primary explosive and having an opening only at one end;

(c) a body for engaging the primary, said body being a core of material having a central cavity with an opening only at one end, said cup and said primary explosive therein being contained in said cavity with said openings of said cup and cavity aligned in communication with one another and the exterior of said body, said body encompassing said cup and primary explosive and being capable of transmitting said shock wave produced by said detonation to the primer; and (d) an energy transfer link having an end extending from the exterior of said body through said aligned openings of said body cavity and said cup and into said cup into direct contact with said primary explosive therein for communicating a source of input energy to said primary explosive for igniting said primary explosive which then detonates.

2. The device of claim 1 wherein said primary explosive is lead azide.

3. The device of claim 1 wherein said body is an an energy-attenuating material.

4. The device of claim 1 wherein said energy transfer link is deflagrating member having one end communicating with said primary explosive and an opposite end communication with the source of input energy for igniting the deflagrating member.

5. The device of claim 4 wherein said deflagrating member is a rapid burn cord, having a predetermined burn time.

6. In combination with an input energy source and a percussion primer having a primer mix and a cup enclosing said primer mix, a shock wave initiator device, comprising:

(a) a primary explosive of a type which upon ignition is capable of detonation for producing a shock wave;

(b) a cup enclosing said primary explosive and having an opening only at one end;

(c) a body having an exterior engaging said primer cup, said body being a core of material having an interior cavity with an opening only at one end, said cup and said primary explosive therein being contained in said cavity with said openings of said cup and cavity aligned in communication with one another and with the exterior of said body, said body encompassing said cup and primary explosive being capable of transmitting said shock wave produced by said detonation to said primer mix in said primer cup; and (d) an elongated deflagrating member having one end extending from the exterior of said body and disposed through said aligned openings of said body cavity and said cup and into said cup in direct energy communicative contact with said primary explosive therein and an opposite end in energy communicative contact with a source of input energy for igniting said member to cause burning thereof which, in turn, ignites and detonates said primary explosive.

7. The device of claim 6 wherein said primary explosive is lead azide.

8. The device of claim 6 wherein said primer has a longitudinal axis and said deflagrating member has a longitudinal axis which extends in generally orthogonal relation to said primer axis.

9. The device of claim 6 wherein said primer has a longitudinal axis and said deflagrating member has a longitudinal axis which extends relative to said primer axis within the range of orthogonal and coaxial relations thereto.

10. The device of claim 6 wherein said body is an an energy-attenuating material.

* * * * *